United States Patent [19]

Ivermee et al.

[11] Patent Number: 4,962,706

[45] Date of Patent: Oct. 16, 1990

[54] FUZE FOR ARTILLERY SHELL

[76] Inventors: Stanley W. O. Ivermee; Raymond G. E. Capnerhurst, both of c/o British Aerospace PLC, Manor Road, Hatfield, Herts, AL10 9LL, United Kingdom

[21] Appl. No.: 347,138

[22] Filed: May 4, 1989

[30] Foreign Application Priority Data

May 4, 1988 [GB] United Kingdom ..... 8810504

[51] Int. Cl.[5] ..... F42C 11/06

[52] U.S. Cl. ..... 102/206; 102/207

[58] Field of Search ..... 102/207, 206

[56] References Cited

U.S. PATENT DOCUMENTS

| | | | |
|---|---|---|---|
| 3,570,404 | 3/1971 | Pope | 102/207 |
| 3,713,391 | 1/1973 | Stout et al. | 102/207 |
| 4,015,531 | 4/1977 | Ziemba | 102/206 |
| 4,240,350 | 12/1980 | Münzel et al. | 102/206 |
| 4,580,498 | 4/1986 | Abt et al. | 102/206 |
| 4,603,635 | 8/1986 | Boudreau | 102/206 |
| 4,632,031 | 12/1986 | Jarrott et al. | 102/206 |
| 4,644,864 | 2/1987 | Komorowski et al. | 102/206 |
| 4,739,705 | 4/1988 | Hudson et al. | 102/206 |
| 4,799,429 | 1/1989 | LaBudde et al. | 102/206 |

*Primary Examiner*—David H. Brown

*Attorney, Agent, or Firm*—Cushman, Darby & Cushman

[57] ABSTRACT

An artillery shell fuze incorporating a long life complete in itself battery and additional features to compensate therefor, which can be programmed to give a very long firing delays e.g.: days, weeks or even months to provide an efficient area denial capability.

5 Claims, 4 Drawing Sheets

FUZE FOR ARTILLERY SHELL

This invention relates to a fuze for an artillery shell. Such a shell comprises a main body with its explosive charge. A safety and arming unit, including a detonator and mechanism (called clutter mechanism) for maintaining the detonator safe until the shell has been properly fired, is included into a fuze which actually initiates the detonator and may be selected from a series of types having respective different functions. For example, one type of fuze may be actuated by proximity with a target, another may be activated on impact, and yet another might be a timer fuze for giving a delayed detonation (the delay being quite short—perhaps a couple of minutes at the most).

Fuzes have to comply with a series of safety and shelf-life controlling rules. For example, it has hitherto been unusual for the drive power to come from the kind of complete-in-itself storage battery which is commonly known. Instead the battery plates and the electrolyte are maintained separate and are only brought together after firing of the shell. This however precludes some options which could otherwise be allowed for.

One object of the invention is to provide a fuze which incorporates a long life, complete-in-itself battery and additional safety features to compensate therefor. A further object is to provide a fuze capable of being programmed to give a very long firing delay, say days, weeks or even months, so as to provide an area denial capability.

According to one aspect of the invention, there is provided a fuze for an artillery shell, the fuze comprising electronic timer means for being programmed to give a selectable delay in production of a detonator initiation signal, an electrical storage battery for powering the timer means, first switch means for isolating the battery from the timer means until after proper firing of the shell, and second switch means for isolating the timer means from a detonator of the fuze until after said proper firing of the shell.

Further aspects of the invention will appear from the following description taken in conjunction with the accompanying drawings which are given by way of example and in which.

Figure 1:
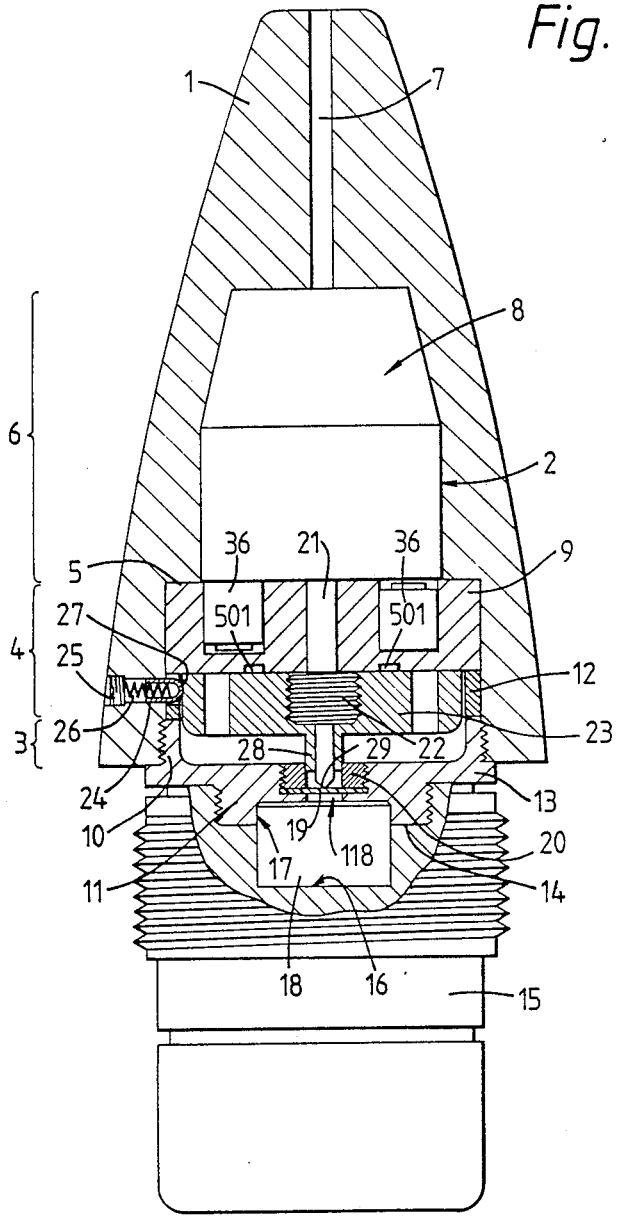
FIG. 1 is a sectioned view of a fuze connected to a safety and arming unit.

Referring to FIG. 1, the illustrated fuze comprises a nose cap 1 having an internal chamber 2 which is open to the rear of the nose cap. From this point, the chamber comprises an internally screw-threaded portion 3, then an unthreaded portion 4 of substantially the same diameter as the portion 3, and then a shoulder 5 leading to a narrower diameter portion 6 which, from a little more than half-way along it, starts to taper inwards slightly so as to conform with the outer shape of the cap. A narrow diameter hole 7 leads forward from chamber 2 out to the tip of the nose cap.

A solidly encapsulated electronic control unit 8 is mounted in chamber portion 6, with which portion the shape of unit 8 comforms and behind this an electrical storage battery and switch carrier module 9 is fitted into chamber portion 6 up against shoulder 5 and the rear face of unit 8. The module 9 supports a number, say four, lithium-oxide electrical storage cells 36 (only two of which can be seen), which are interconnected to form two independent batteries, each battery comprising two of the cells in series, and in addition, for each battery, a two-pole isolating switch 501. Each switch is connected to the associated battery, one pole to each side thereof, and to the electronic control unit 8 and is operable to remain open, i.e. to maintain the battery totally isolated from the unit 8 until it experiences a stimulus, for example so-called rotation and set-back (a term well known to those skilled in the art), consequent upon a correct firing of an artillery shell (not shown), to which the fuze is fitted. An externally screw-threaded portion 10 of a sealing and interface member 11 is engaged with the threaded portion 3 of chamber 2 so that, via a castellated spacer ring 12 positioned between the member 11 and module 9, the module 9 and consequently also the unit 8 are clamped in position in the chamber. An O-ring seal (not shown) may be positioned between the rear face of cap 1 and an outwardly extending flange 13 of the member 11 so as to environmentally seal the chamber 2.

The member 11 also comprises a rearwardly extending, externally screw-threaded portion 14 by which there is connected to the fuze a Gaine-type safety and arming unit (SAU) incorporating 'clutter mechanism' 15. Unit 15 has a forward facing recess 16 matching a shallow rear-facing recess 17 formed in the member 11 and, in the chamber 18 formed by the two recesses, there is a detonator capsule holder (not shown).

The unit 15 itself is a well-known and readily available item of military equipment. Basically, it contains means defining a firing path leading, when in position in an artillery shell (not shown), from an electrically ignitable detonator to the main explosive charge of the shell and also a mechanism in which maintains the detonator holder in a safe position with the capsule isolated from the fuze unless and until predetermined safety-related conditions have been met, for example the achievement of pre-set values of linear and angular acceleration of the shell. Alternate to a Gaine-type unit, any other suitable type of safety and arming unit may be used.

From the front face of the recess 17, there extends a hole 118 in member 11 and, after a short distance, this hole becomes wider and is screw-threaded. A disc 19 made of plastics material such as Melinex (trade name) is positioned in the wider part of the hole 18 and held there by a ring-shaped bush 20, engaged with the screw-thread in this wider part of the hole. The disc 19 thus seals chamber 2 from chamber 18.

Fixed into an axially extending hole in the module 9 is spigot 21 having an externally screw-threaded portion 22 extending from the rear face of module 9 back towards the member 11 and, screwed onto this portion 22 so that it lies up against the rear face of module 9, there is a flywheel 23. A radially-extending hole 24 is provided in the nose cap 1 leading into the chamber 3 adjacent the periphery of flywheel 23 and, in this hole 24, there is mounted a detent peg 25, a compression spring 26, and a set-screw 27, the spring being between the set-screw and the detent peg and being operable to urge the peg inwardly into engagement with a depression formed in the periphery of the flywheel. As a modification (not shown) for greater security, there could be two or more, say four, radial holes equispaced around the nose cap and each containing a set-screw, a spring and a detent peg urged by the associated spring into engagement with a matching depression in the flywheel periphery.

From the rear face of the flywheel 23, there extends a fixed prob 28 having a pointed end 29 entered into the central hole in bush 20 and close to the forward face of the disc 19.

On firing of a shell to which the illustrated fuze and SAU are fitted, the detent peg 25 becomes disengaged from flywheel 23 in response to the centrifugal force generated by the spin of the shell whereupon, because the rotation of the flywheel 23 tends to lag that of the shell, the flywheel screws itself along screw-threaded portion 22 of spigot 21 so that the pointed end 29 of probe 28 pierces disc 19 and enter chamber 18.

Meanwhile, firing of the shell will have started the operation of safety and arming unit 15 so that, given achievement of the aforementioned safety-related conditions entry of the probe 28 into chamber 18 will coincide with the initiation contact of the detonator capsule being brought by unit 15 into alignment with the probe whereupon the probe engages the contact.

The switches 501 could comprise magnetically operable switches influenced by a permanent magnet arrangement (not shown) having a flux circuit partly within fly wheel 23 so that, as fly wheel and unit 9 move relative to one another, the switches operate.

Figure 2:
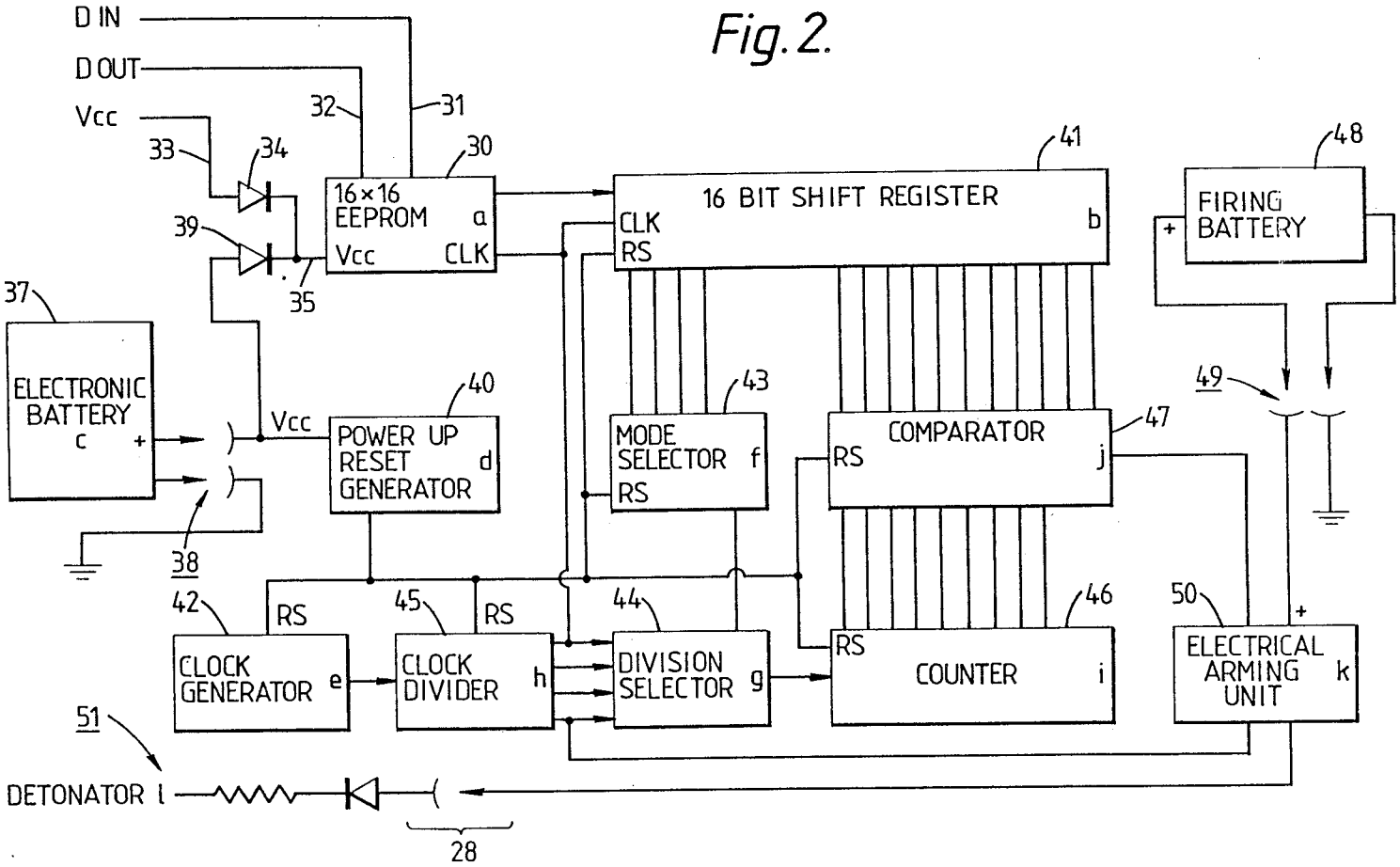
FIG. 2 is a simplified circuit diagram of the fuze.

Referring now to FIG. 2, the control unit "a" comprises an electrically eraseable and programmable read-only memory (EEPROM) 30 having a 16×16 bit capacity and incorporating address logic (not shown per se) so that a serial data stream can be entered into it via connector line 31 and also so that the stored data can be read out in series via connector line 32. A connector line 33 leads via a diode 34 to the drive voltage terminal 35 of the memory. The free ends of lines 31, 32 and 33 are terminated so as to be accessible to a connector probe (not shown) entered into the fuze via the hole 7 shown in FIG. 1.

The negative side of one of the two batteries formed by cells 36, the battery 37 in FIG. 2, is connected via one pole of its associated isolating switch 38 to a common ground line of the unit "a" while the positive side of the battery is connected via the other pole of the switch 30 and a diodc 39 to the drive voltage terminal 35. This side of the battery 37 is also connected, via switch 38 but not diode 39, to the respective power drive terminals of each of reset signal generator 40 and of control unit items 41 to 47, which items will be introduced in the following description. For simplicity, the actual power connections to the items 41 to 47 are not shown.

Basically the electronic control unit "a" consists of a programmable timer with the EEPROM 30 used as a non-volatile memory which can be programmed using a separate programming station (not shown) coupled to the aforementioned connector probe (not shown). Using the programming station and probe, programme data previously entered into the EEPROM 30 can also be verified or replaced by new programme data.

The reset signal generator 40 generates a reset pulse which is applied to the reset inputs of the items 41 to 47 when it starts to receive power from battery 37 via switch 38, i.e. it applies a power-up reset to each of the items 41 to 47. Those items comprise:

41 16 bit shift register—to which the program data is loaded when the local system is powered-up.

42 Clock Generator—provides Data Clock and Time Base via Divider.

43 Mode Selector.

44 Division Selector—defines timer range/s.

45 Clock Divider.

46 Counter—counts pluses from divider.

47 Comparator—compares content of register 41 and counter 46 and produces an output singal when they are identical.

The battery 48 formed by the other cells in module 9 is connected via its associated switch 49 to an electrical arming unit 50 which, for an initial time period following the application of power thereto from battery 48 is inhibited, i.e. it ignores all stimuli, but then becomes responsive to a signal when supplied from comparator 47 to generate a detonation signal for initiating the detonator 51 via the by then extended probe 28.

As well as the items shown, normally the electronic control unit will also comprise some form of impact detector, for example an accelerometer or wire-break circuit coupled say to the mode selector for enabling the shell to be detonated on impact or after a delay following impact. A tamper detection device (not shown) could also be provided to set the shell off if it is tampered with after firing, say if the timer has been programmed to give a long delay (days or weeks) before detonation. A magnetometer could also be provided to set the shell off say at the approach of a vehicle.

Figure 3:
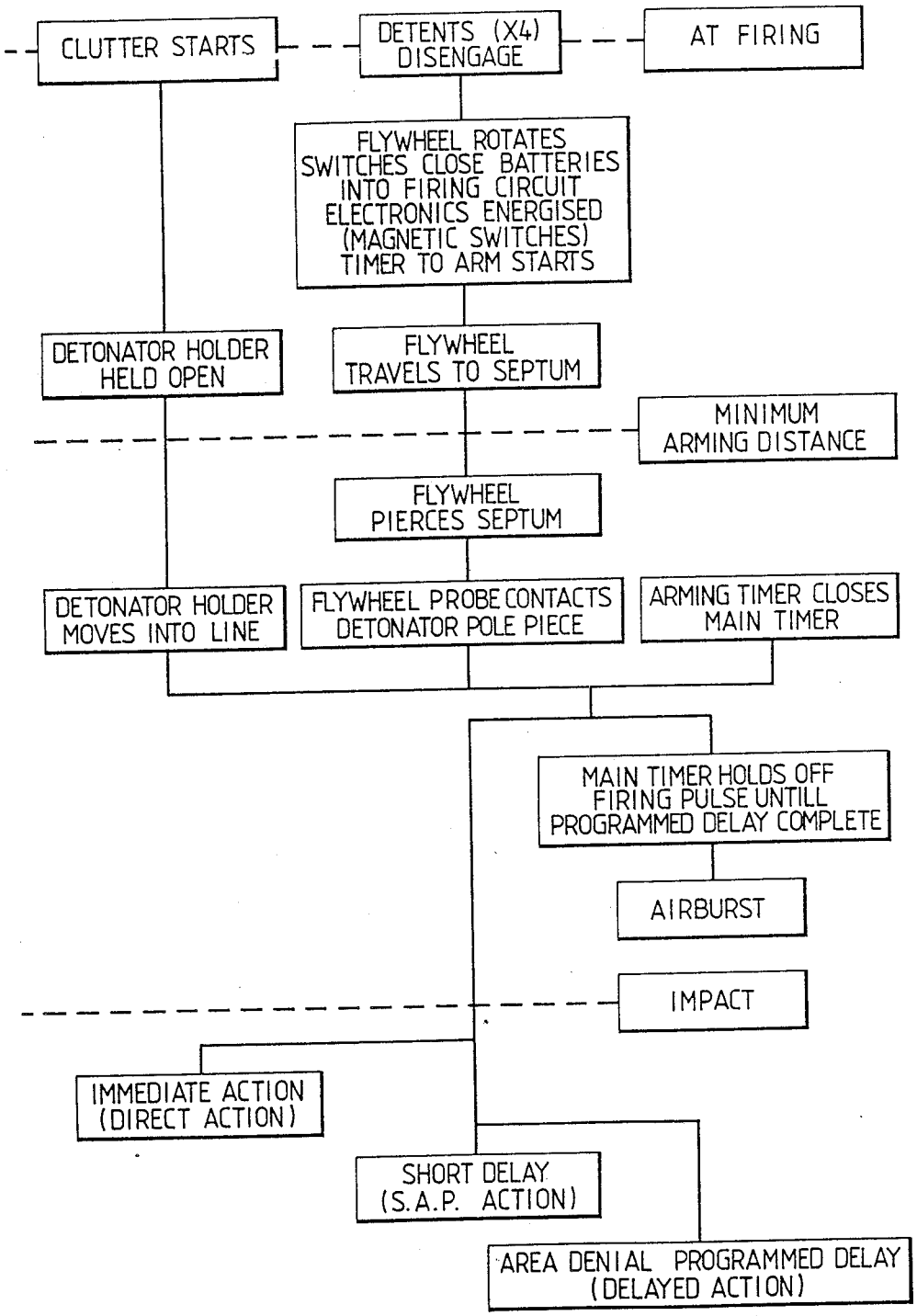
FIG. 3 is a flow chart for illustrating the operation of the fuze and the safety and arming unit.

Referring also to the flow chart of FIG. 3, the operation of the fuze is summarised as follows:

1. During programming the timer system is not powered, being mechanically isolated from the on-board battery supply. The EEPROM 30 is powered from the external program source and after an initial Reset/Erase sequence receives the serial data stream from the Programmer. If required the EEPROM can be interrogated to read or confirm the inplanted data. The EEPROM may be reprogrammed by repeating the above sequence as often as required to accommodate changes of scenario.
2. After programming the EEPROM and the logic circuits remain unpowered until the battery 37 is mechanically connected as a result of displacement due to an environmental stimulus: rotation and set-back. The detonator battery 48 is similarly connected by a separate mechanism.
3. Application of battery power to the power-up-detector 40 provides a reset pulse to the logic devices 41 to 47.
4. The Clock Generator 42 output is applied via the divider 45 to the EEPROM 30 and the program data is loaded to the Shift Register 41.
5. The Mode Select 43 sets the division select 44 to one of the four divided 44 ranges to provide the appropriate scale factor for the timer/counter 46.
6. As the counter 46 advances its output stratus is applied to the comparator 47 which compares with the set status of the shift register 41 and produces an output signal when the states are coincident.
7. The electronic arming unit 50 is initially inhibited until first pulse is received from a slow output of the divider 45, providing additional early trajectory protection. When subsequently a pulse is received from the comparator 47 the mechanically armed battery circuit is switched to the detonator to initiate the explosive charge.

Selectable System Functions (a) The mode select function will switch alternative inputs from inertial or wire break detectors (not shown) directly to the electronic arming unit to provide "super quick" initiation of the detonator as a result of a glancing contact during the flight trajectory or terminal impact resulting in decleration above a critical threshold.

(b) The division select switches between the outputs of the (fixed) divider provide a range of time functions between short delay periods to weeks.

(c) The resolution of timed periods is related to the selected range of division. Short delays are defined using the fastest pulse rate, whereas long and extended delays of many days duration use the slowest pulse rates. The accuracy of the counter comparator is consistent for all ranges.

Figure 4:
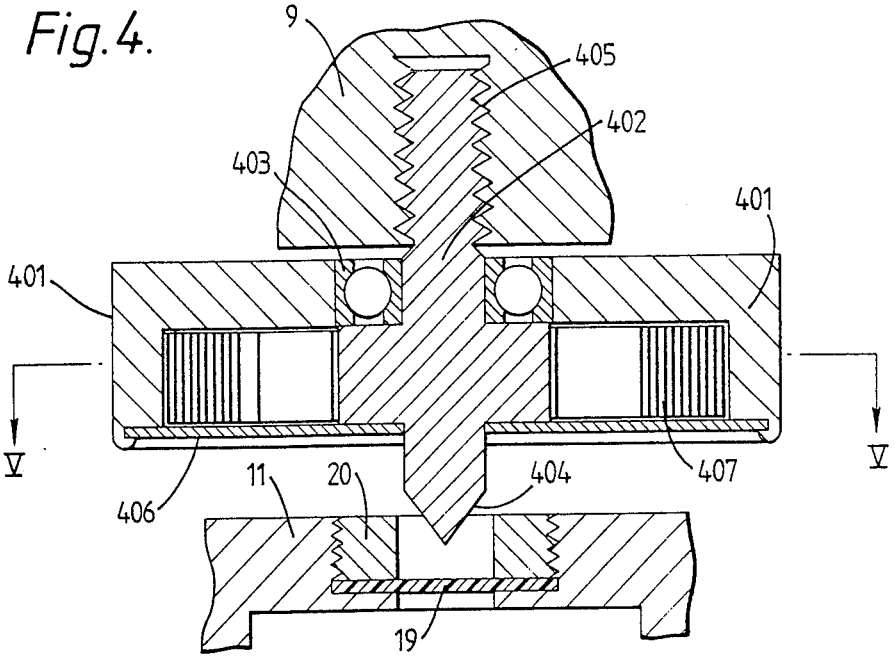
FIGS. 4 and 5 are respectively a sectional elevation of a part of a modified fuze and a section on V V in FIG. 4.
Figure 5:
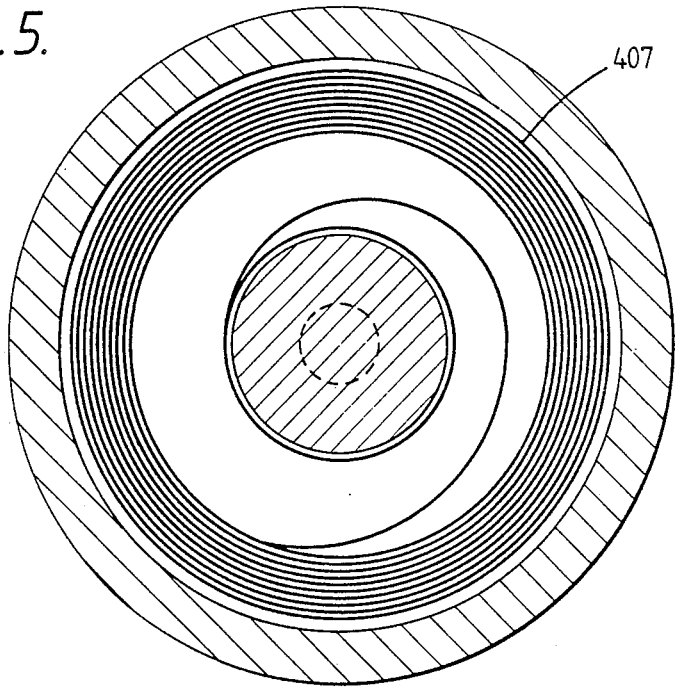

The flywheel 23 and spigot 21 in FIG. 1 could by replaced by the modified elements shown in FIGS. 4 and 5. Here there is a hollow flywheel 401 rotatably mounted on a hub shaft 402 by way of a ball bearing 403. The hub shaft 402 has a pointed end 404 and a screw-threaded end 405, the screw-thread end 405 being engaged in a matching threaded hole in switch carrier unit 9 (only partly shown in FIG. 4). The hollow flywheel 401, which is closed by a welded on or otherwise fixed lid 406, contains a coil of steel tape 407. The coil lies against the inner surface of the peripheral wall of the flywheel 401 and has its outermost end fixed to the fly wheel and its inner end fixed to the hub-shaft 402.

As before, the flywheel is initially held fixed with respect to the fuze body of centrifugal latch members (not shown in FIGS. 4 and 5) which could comprise compression spring/detent peg arrangements as in FIG. 1. On firing of the shell, the centrifugal latches release the flywheel which thereby tends to remain still while the shell and the fuze including hub-shaft 402 rotates with respect to it. This causes the coil of steel tape 407 to be wound off the wall of flywheel 401 and onto the hub-shaft 402. When fully wound onto the hub-shaft, because the outer end of the tape is connected to the flywheel, the flywheel retards the hub-shaft by pulling back on it via the tape so now the screwed end of the hub-shaft starts to screw itself down out of the threaded hole in member 9, bringing its opposite pointed end into contact with and through disc 19 as before. The operation of the coil of tape in this modification gives a greater arming delay, i.e. a greater safe distance from the gun to the point at which the shell becomes armed.

It should be noted that the tape 407, need not necessarily be of steel, but may be of any suitable material, for example nylon.

We claim:

1. A fuze for an artillery shell, the fuze comprising:

electronic means for being programmed with a set of required data conditions, said electronic means including a comparator means for comparing the required conditions with a set of actual data conditions, and producing a detonation ignition signal when the required conditions are met;

an electrical storage battery for powering the electronic means;

first switch means for isolating the battery and the electronic means prior to launch of the shell and connecting the batttery and electronic means at a first predetermined time after launch of the shell; and second switch means for connecting the electronic means to a detonator in the shell, at a second predetermined time after launch of the shell and for transmitting the detonation signal to said detonator, thereby initiating detonation of the shell.

2. A fuze, according to claim 1, wherein the first and second switch means are connected by the action of a rotatable member, associated with the shell and, capable of rotating relative to the shell such that a first contact means for each switch means, which are associated with said rotatable member, are brought into contact with respective second contact means associated with the shell; said contact connecting said first and second switch means at the respective first and second predetermined times.

3. A fuze according to claim 1 or claim 2 wherein said first switch means is magnetically operable.

4. A fuze according to claim 2, wherein said rotatable member comprises a screw-threaded flywheel which rotates on a spigot, said flywheel rotating at a different rate to the rotation rate of the shell, thereby causing relative movement between the flywheel and the shell to effect said contact.

5. A fuze according to claim 4, wherein the flywheel is inhibited from moving prior to launch of the shell by locking means which may be disengaged, due to centripetal forces acting on the shell after launch.

* * * * *